US010568800B2

(12) United States Patent
Andersen

(10) Patent No.: US 10,568,800 B2
(45) Date of Patent: Feb. 25, 2020

(54) ROLLATOR

(71) Applicant: Medline Industries, Inc., Northfield, IL (US)

(72) Inventor: Margaret M. Andersen, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 16/390,225

(22) Filed: Apr. 22, 2019

(65) Prior Publication Data

US 2019/0240107 A1 Aug. 8, 2019

Related U.S. Application Data

(63) Continuation of application No. 15/980,164, filed on May 15, 2018, now Pat. No. 10,307,322, which is a (Continued)

(51) Int. Cl.
*A61H 3/04* (2006.01)
*A61H 3/00* (2006.01)

(52) U.S. Cl.
CPC ..... *A61H 3/04* (2013.01); *A61H 2003/002* (2013.01); *A61H 2003/004* (2013.01); (Continued)

(58) Field of Classification Search
CPC ..... A61H 3/04; A61H 2201/0192; A61H 2201/1633; B60N 3/102; B64D 11/0638
See application file for complete search history.

(56) References Cited

U.S. PATENT DOCUMENTS 474,666 A 5/1892 Krehbiel
2,649,270 A 8/1953 Franks
(Continued)

FOREIGN PATENT DOCUMENTS

CN 1602826 4/2005
CN 201019980 2/2008
(Continued)

OTHER PUBLICATIONS

"Adjustable Rollator by Patterson Medical", Medline product currently available at https://www.medline.com/product/Adjustable-Rollator-by-Patterson-Medical/Rollators/Z05-PF55372?question=rollator&index=P35&indexCount=35, believed to be publicly available at least before Oct. 13, 2016.
(Continued)

*Primary Examiner* — Bryan A Evans
(74) *Attorney, Agent, or Firm* — Fitch, Even, Tabin & Flannery LLP

(57) ABSTRACT

A rolling walker comprises a frame, a seat supported by that frame, and a backrest supported by the frame. By one approach the backrest is configured to selectively move between a first position that provides back support for a person sitting in the seat facing in a forward direction and a second position that provides back support for a person sitting in the seat facing in a rearward direction. If desired, this backrest can be comprised of a material (such as a memory foam material) that biases the backrest towards that first position when the backrest is in the first position and that biases the backrest towards the second position when the backrest is in the second position.

9 Claims, 18 Drawing Sheets

Related U.S. Application Data continuation of application No. 15/722,090, filed on Oct. 2, 2017, now Pat. No. 9,968,509, which is a continuation of application No. 14/987,208, filed on Jan. 4, 2016, now Pat. No. 9,775,766, which is a continuation of application No. 14/072,206, filed on Nov. 5, 2013, now Pat. No. 9,226,868.

(60) Provisional application No. 61/723,067, filed on Nov. 6, 2012.

(52) U.S. Cl.
CPC ..... *A61H 2201/0161* (2013.01); *A61H 2201/1633* (2013.01)

(56) References Cited

U.S. PATENT DOCUMENTS

| | | | |
|---|---|---|---|
| 3,186,759 | A | 6/1965 | Reeves |
| 3,338,628 | A | 8/1967 | Evans |
| 3,391,891 | A | 7/1968 | Garden |
| 4,211,309 | A | 7/1980 | Ruggiero |
| 4,229,039 | A | 10/1980 | Day |
| 4,341,381 | A | 7/1982 | Norberg |
| D281,771 | S | 12/1985 | Webb |
| D289,507 | S | 4/1987 | Danielsson |
| 5,058,912 | A | 10/1991 | Harroun |
| 5,060,967 | A | 10/1991 | Hulterstrum |
| 5,224,731 | A | 7/1993 | Johnson |
| 5,320,122 | A | 6/1994 | Jacobson, II |
| 5,342,009 | A | 8/1994 | Lehner |
| 5,364,120 | A | 11/1994 | Shimansky |
| 5,419,571 | A | 5/1995 | Vaughan |
| D360,174 | S | 7/1995 | Kjell |
| D367,833 | S | 3/1996 | Ahlbertz |
| D372,890 | S | 8/1996 | Ferm |
| 5,716,063 | A | 2/1998 | Doyle |
| 5,741,020 | A | 4/1998 | Harroun |
| 5,772,234 | A | 6/1998 | Luo |
| D396,437 | S | 7/1998 | Liljedahl |
| 5,904,168 | A | 5/1999 | Alulyan |
| 6,045,017 | A | 4/2000 | Connell |
| 6,338,493 | B1 | 1/2002 | Wohlgemuth |
| 6,378,883 | B1 | 4/2002 | Epstein |
| D501,432 | S | 2/2005 | Møller |
| D503,909 | S | 4/2005 | Tolfsen |
| D519,423 | S | 4/2006 | Tolfsen |
| 7,192,043 | B1 | 3/2007 | McLuen |
| 7,219,906 | B2 | 5/2007 | Hallgrimsson |
| 7,306,246 | B2 | 12/2007 | Gale |
| D560,563 | S | 1/2008 | Fransson |
| 7,370,734 | B2 | 5/2008 | Hallgrimsson |
| 7,379,734 | B2 | 5/2008 | Sato |
| 7,484,740 | B2 | 2/2009 | Miller |
| 7,628,411 | B2 | 12/2009 | Meyers |
| D623,992 | S | 9/2010 | Derks |
| D633,830 | S | 3/2011 | Derks |
| 7,918,473 | B2 | 4/2011 | Yao |
| 8,083,240 | B2 | 12/2011 | Jacobs |
| 8,226,111 | B2 | 7/2012 | Valdez |
| 8,245,894 | B2 | 8/2012 | Buehler |
| 8,596,669 | B2 | 12/2013 | Liao |
| D699,634 | S | 2/2014 | Wu |
| 8,646,804 | B2 | 2/2014 | Derks |
| 8,851,502 | B2 | 10/2014 | Gaudiano |
| D721,620 | S | 1/2015 | Huang |
| 8,936,262 | B2 | 1/2015 | Nabeta |
| 8,979,114 | B2 | 3/2015 | Cheng |
| 8,998,222 | B2 | 4/2015 | Huang |
| 8,998,223 | B2 | 4/2015 | Chang |
| D736,121 | S | 8/2015 | Wang |
| D739,314 | S | 9/2015 | Wang |
| 9,173,802 | B2 | 11/2015 | Willis |
| 9,226,868 | B2 | 1/2016 | Andersen |
| 9,241,554 | B1 | 1/2016 | Tong |
| D754,034 | S | 4/2016 | Wang |
| D754,568 | S | 4/2016 | Wang |
| 9,381,132 | B2 | 7/2016 | Chen |
| D766,139 | S | 9/2016 | Chen |
| D789,255 | S | 6/2017 | Delatorre |
| 9,687,411 | B2 | 6/2017 | Chen |
| D795,752 | S | 8/2017 | Wang |
| D795,753 | S | 8/2017 | Wang |
| 9,763,849 | B2 | 9/2017 | Paterson |
| D798,778 | S | 10/2017 | Lin |
| D801,231 | S | 10/2017 | Wang |
| 9,775,766 | B2 | 10/2017 | Andersen |
| 9,839,571 | B2 | 12/2017 | Pan |
| D807,793 | S | 1/2018 | Paterson |
| 9,877,889 | B2 | 1/2018 | Chen |
| 9,907,723 | B2 | 3/2018 | Bisceglia |
| 9,968,509 | B2 | 5/2018 | Andersen |
| 9,974,708 | B1 | 5/2018 | Janeczek |
| 2002/0050697 | A1 | 5/2002 | Hallgrimsson |
| 2002/0079663 | A1* | 6/2002 | Hallgrimsson ..... A61G 5/08 280/87.041 |
| 2002/0153684 | A1 | 10/2002 | Sung |
| 2004/0079405 | A1 | 4/2004 | Sanders |
| 2004/0104559 | A1 | 6/2004 | Chen |
| 2004/0118640 | A1 | 6/2004 | Hallgrimsson |
| 2004/0245737 | A1 | 12/2004 | Hallgrimsson |
| 2005/0001398 | A1 | 1/2005 | Serhan |
| 2006/0284040 | A1 | 12/2006 | Nixon |
| 2007/0034243 | A1 | 2/2007 | Miller |
| 2007/0170699 | A1 | 7/2007 | Li |
| 2007/0235067 | A1 | 10/2007 | Gale |
| 2007/0267054 | A1 | 11/2007 | Meyers |
| 2007/0283990 | A1 | 12/2007 | Fernandez |
| 2008/0111349 | A1* | 5/2008 | Willis ..... A61H 3/04 280/648 |
| 2008/0129016 | A1 | 6/2008 | Willis |
| 2008/0135077 | A1 | 6/2008 | Meyers |
| 2008/0202571 | A1 | 8/2008 | Meyers |
| 2008/0252043 | A1 | 10/2008 | Willis |
| 2009/0033052 | A1 | 2/2009 | Bradshaw |
| 2010/0301574 | A1 | 12/2010 | Derks |
| 2012/0060877 | A1 | 3/2012 | Kirby |
| 2012/0205882 | A1 | 8/2012 | Staggs |
| 2013/0113187 | A1 | 5/2013 | Willis |
| 2013/0292916 | A1 | 11/2013 | Nabeta |
| 2013/0320640 | A1 | 12/2013 | Liu |
| 2014/0084559 | A1 | 3/2014 | Fang |
| 2014/0125037 | A1 | 5/2014 | Andersen |
| 2015/0182394 | A1 | 7/2015 | Kutsch |
| 2016/0113833 | A1 | 4/2016 | Andersen |
| 2018/0021204 | A1 | 1/2018 | Paterson |

FOREIGN PATENT DOCUMENTS

| | | |
|---|---|---|
| CN | 202724206 | 2/2013 |
| DE | 29717488 | 11/1997 |
| EP | 2343035 | 8/2012 |
| JP | D1148308 | 7/2002 |
| JP | D1292289 | 1/2007 |
| TW | D107853 | 11/2005 |
| TW | D127741 | 3/2009 |

OTHER PUBLICATIONS

"Bariatric RollAider™ by Patterson Medical", Medline product currently available at https://www.medline.com/product/Bariatric-RollAider153-by-Patterson-Medical/Rollators/Z05-PF74285?question=rollator&index=P43&indexCount=43, believed to be publicly available at least before Oct. 13, 2016.

"Basic Rollators", Medline product currently available at https://www.medline.com/product/Basic-Rollators/Rollators/Z05-PF04832?question=rollator&index=P4&indexCount=4, believed to be publicly available at least before Oct. 13, 2016.

"Basic Steel Rollators", Medline product currently available at https://www.medline.com/product/Basic-Steel-Rollators/Rollators/Z05-PF61071?question=rollator&index=P10&indexCount=10, believed to be publicly available at least before Oct. 13, 2016.

(56) References Cited

OTHER PUBLICATIONS

"Deluxe Comfort Rollators", Medline product currently available at https://www.medline.com/product/Deluxe-Comfort-Rollators/Rollators/Z05-PF61367?question=rollator&index=P8&indexCount=8, believed to be publicly available at least before Oct. 13, 2016.
"Deluxe Rollators", Medline product currently available at https://www.medline.com/product/Deluxe-Rollators/Rollators/Z05-PF04834?question=rollator&index=P6&indexCount=6, believed to be publicly available at least before Oct. 13, 2016.
"Empower Rollator", Medline product currently available at https://www.medline.com/product/Empower-Rollator/Rollators/Z05-PF75510?question=rollator&index=P11&indexCount=11, believed to be publicly available at least before Oct. 13, 2016.
"Guardian Deluxe Rollators with 8" Wheels", Medline product currently available at https://www.medline.com/product/Guardian-Deluxe-Rollators-with-8-Wheels/Rollators/Z05-PF04840?question=rollator&index=P1&indexCount=1#mrkSpec, believed to be publicly available at least before Oct. 13, 2016.
"Guardian Economy Rollators", Medline product currently available at https://www.medline.com/product/Guardian-Economy-Rollators/Rollators/Z05-PF04841?question=rollator&index=P9&indexCount=9, believed to be publicly available at least before Oct. 13, 2016.
"Invacare® Rollite™ Rollator by Patterson Medical", Medline product currently available at https://www.medline.com/product/Invacare-Rollite153-Rollator-by-Patterson-Medical/Rollators/Z05-PF59721?question=rollator&index=P37&indexCount=37, believed to be publicly available at least before Oct. 13, 2016.
"Light Weight Extra Wide Heavy-Duty Alumi", Medline product currently available at https://www.medline.com/product/Light-Weight-Extra-Wide-Heavy-Duty-Alumi/Rollators/Z05-PF55515?question=rollator&index=P41&indexCount=41, believed to be publicly available at least before Oct. 13, 2016.
"Luxe Rollator", Medline product currently available at https://www.medline.com/product/Luxe-Rollator/Rollators/Z05-PF04842?question=rollator&index=P7&indexCount=7, believed to be publicly available at least before Oct. 13, 2016.
"Posh Pink Zebra Rollator", Medline product currently available at https://www.medline.com/product/Posh-Pink-Zebra-Rollator/Rollators/Z05-PF70685?question=rollator&index=P21&indexCount=21, believed to be publicly available at least before Oct. 13, 2016.
"Rollators with 8" Wheels", Medline product currently available at https://www.medline.com/product/Rollators-with-8-Wheels/Rollators/Z05-PF04844?question=rollator&index=P2&indexCount=2, believed to be publicly available at least before Oct. 13, 2016.
"Set n' Go Height Adjustable Rollator by Graham-Field", Medline product currently available at https://www.medline.com/product/Set-n-Go-Height-Adjustable-Rollator-by-Graham-Field/Rollators/Z05-PF110256?question=rollator&index=P29&indexCount=29, believed to be publicly available at least before Oct. 13, 2016.
"Simplicity Rollator", Medline product currently available at https://www.medline.com/product/Simplicity-Rollator/Rollators/Z05-PF71394?question=rollator&index=P12&indexCount=12c, believed to be publicly available at least before Oct. 13, 2016.
"Standard Bariatric Heavy Duty Rollator", Medline product currently available at https://www.medline.com/product/Standard-Bariatric-Heavy-Duty-Rollator/Rollators/Z05-PF04829?question=rollator&index=P3&indexCount=3, believed to be publicly available at least before Oct. 13, 2016.
"Stealth Rollator", Medline product currently available at https://www.medline.com/product/Stealth-Rollator/Rollators/Z05-PF71395?question=rollator&index=P19&indexCount=19, believed to be publicly available at least before Oct. 13, 2016.
"Tri-Wheeled Rollators", Medline product currently available at https://www.medline.com/product/Tri-Wheeled-Rollators/Rollators/Z05-PF04845?question=rollator&index=P16&indexCount=16, believed to be publicly available at least before Oct. 13, 2016.
"U-Step Walking Stabilizer by Alimed", Medline product currently available at https://www.medline.com/product/U-Step-Walking-Stabilizer-by-Alimed/Rollators/Z05-PF57847?question=rollator&index=P48&indexCount=48, believed to be publicly available at least before Oct. 13, 2016.
"Ultralight Rollators", Medline product currently available at https://www.medline.com/product/Ultralight-Rollators/Rollators/Z05-PF04838?question=rollator&index=P5&indexCount=5, believed to be publicly available at least before Oct. 13, 2016.
"Walker CarryOn! Bags by Patterson", Medline product currently available at https://www.medline.com/product/Walker-CarryOn-Bags-by-Patterson-Medical/Parts-Accessories/Z05-PF58535?P19&indexCount=19, believed to be publicly available at least before Oct. 13, 2016.
"Width Adjustable Rollators", Medline product currently available at https://www.medline.com/product/Width-Adjustable-Rollators/Rollators/Z05-PF103010?question=rollator&index=P18&indexCount=18, believed to be publicly available at least before Oct. 13, 2016.
"Winnie Mimi Lite-RollatorTransport Cha", Medline product currently available at https://www.medline.com/product/Winnie-Mimi-Lite-Rollator-Transport-Cha/Rollators/Z05-PF43257?question=rollator&index=P53&indexCount=53, believed to be publicly available at least before Oct. 13, 2016.
Australian Office Action from Australian Patent Application No. 2013341540 dated Feb. 10, 2017.
Chinese Office Action from Chinese Patent Application No. 201310547406.7 dated Sep. 2, 2016 with English translation.
Chinese Office Action from Chinese Patent Application No. 201680032232.2 (with English translation) dated Aug. 10, 2018; 11 pages.
Copenheaver, Blaine R.; Authorized Officer; International Search Report and Written Opinion from related International Application No. PCT/US2016/026936; dated Jul. 6, 2016; 14 pages.
Extended European Search Report from European Patent Application No. 13853894.7 dated Jun. 17, 2016.
PCT Patent Application No. PCT/US2013/068116; International Search Report and Written Opinion dated Feb. 13, 2014.
PCT Search Report and Written Opinion from International Application No. PCT/US2016/026936 dated Jul. 6, 2016; 14 pages.
Taiwanese Search Report from TW102303182 dated Jul. 17, 2014.

* cited by examiner

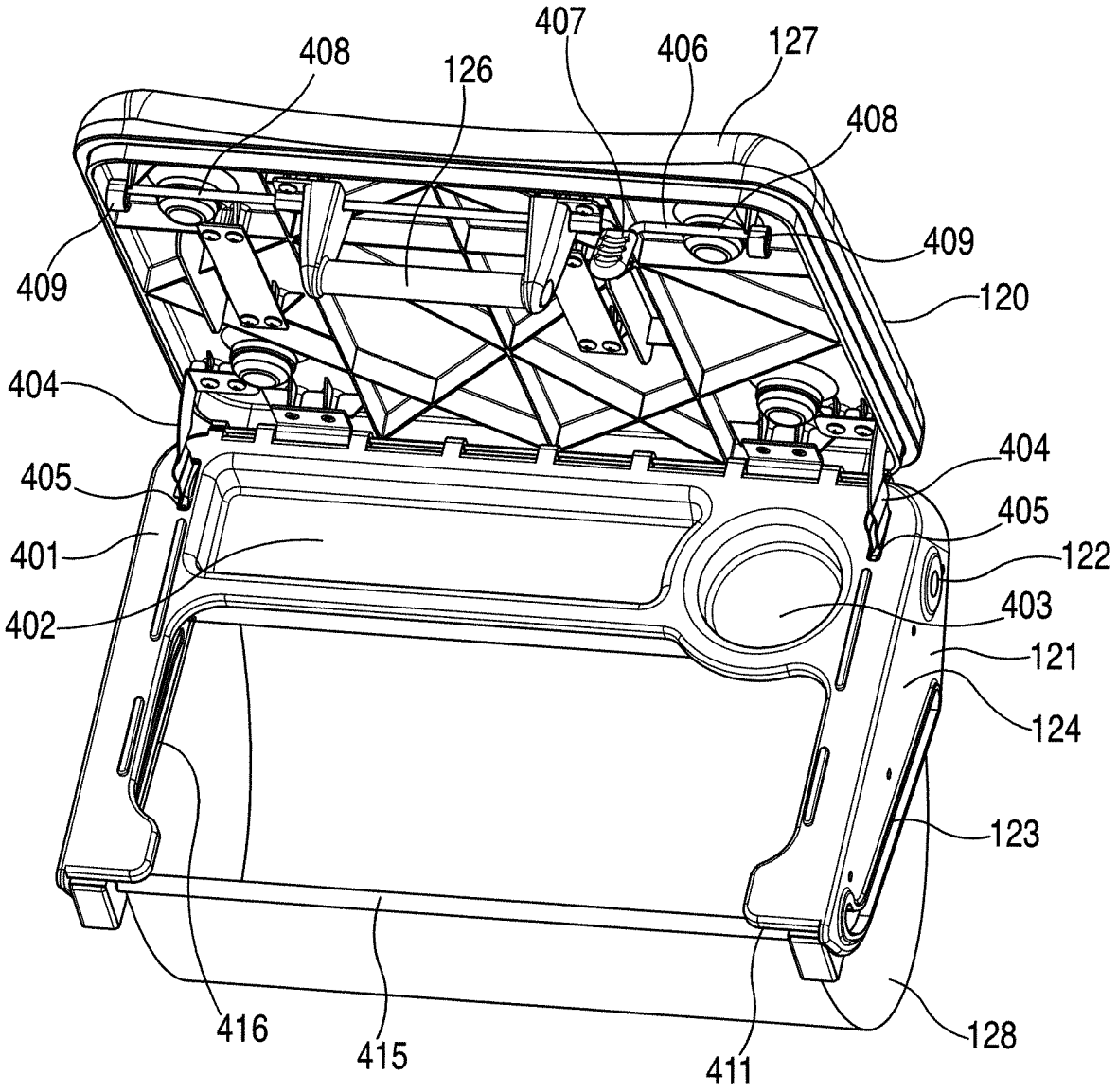
FIG. 4.1

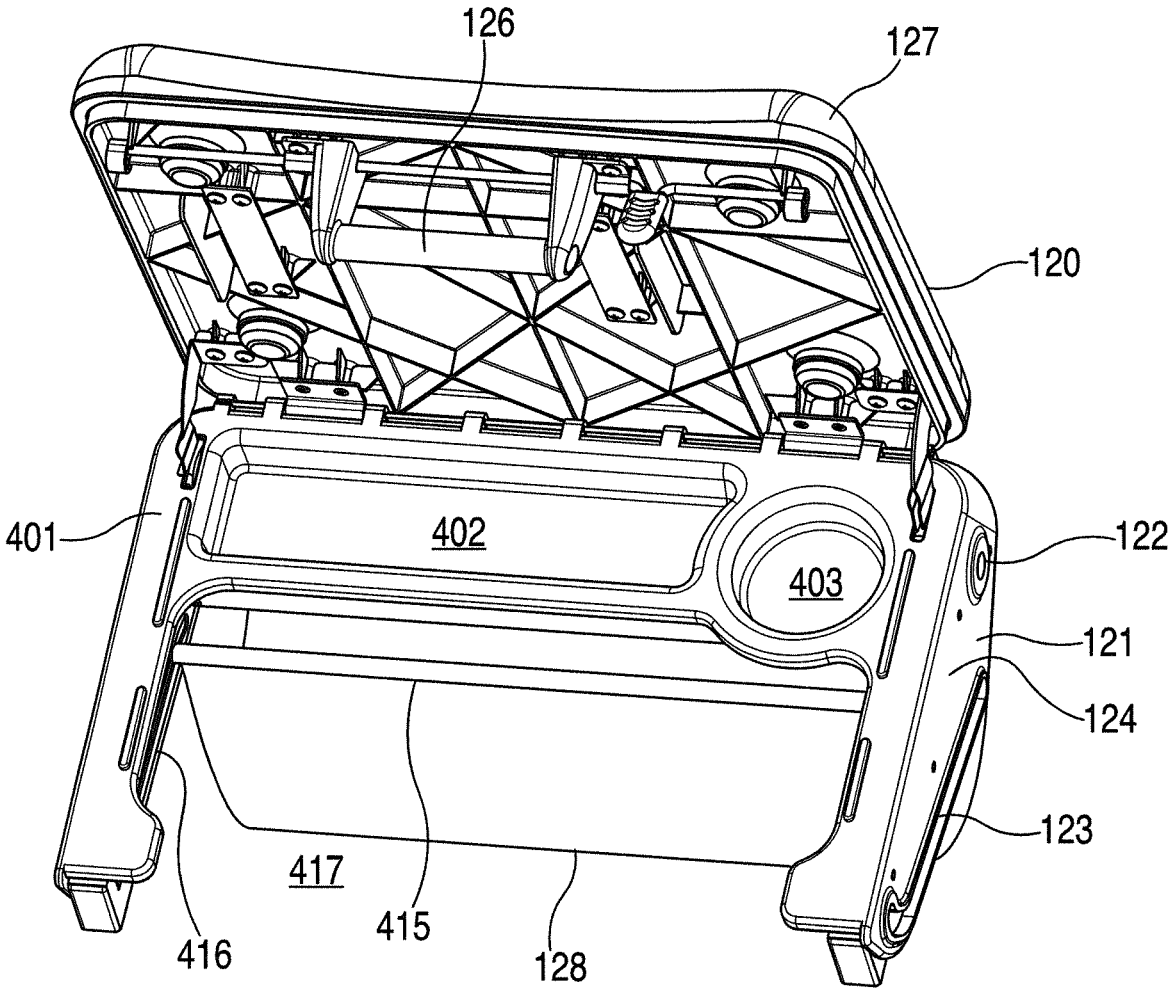
FIG. 4.2

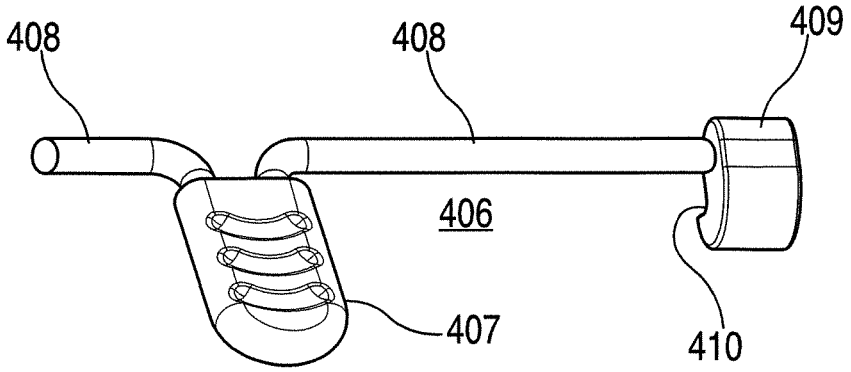
FIG. 4.1a
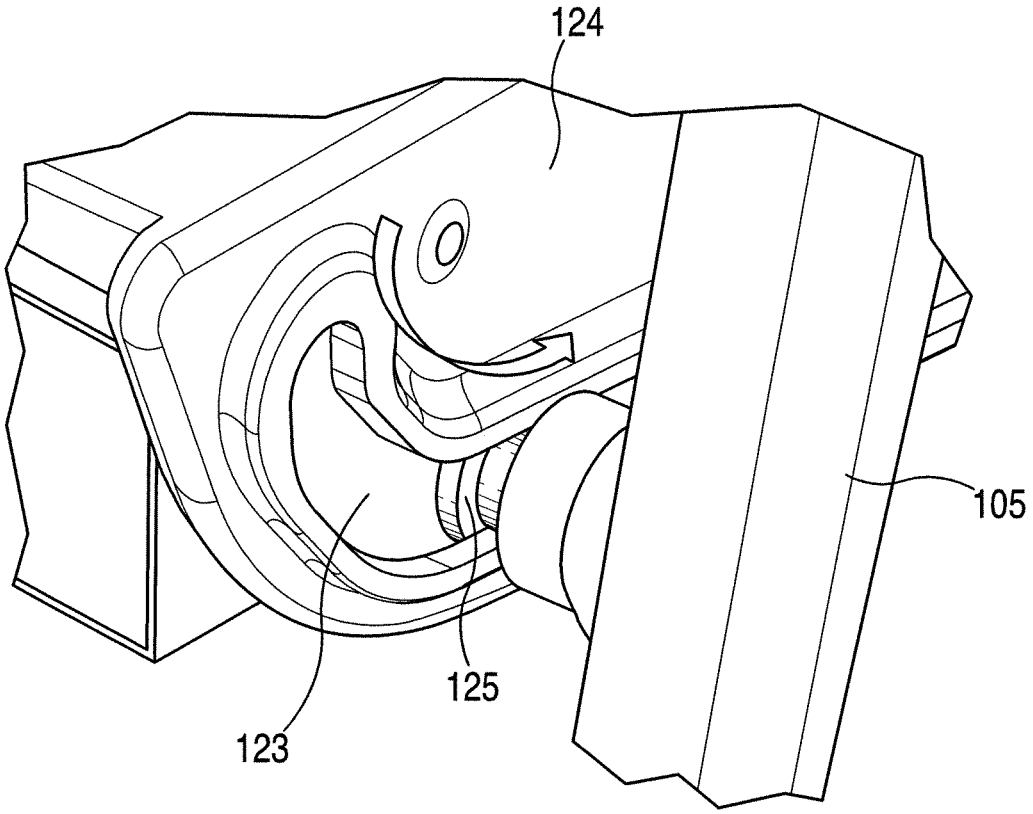
FIG. 4.3

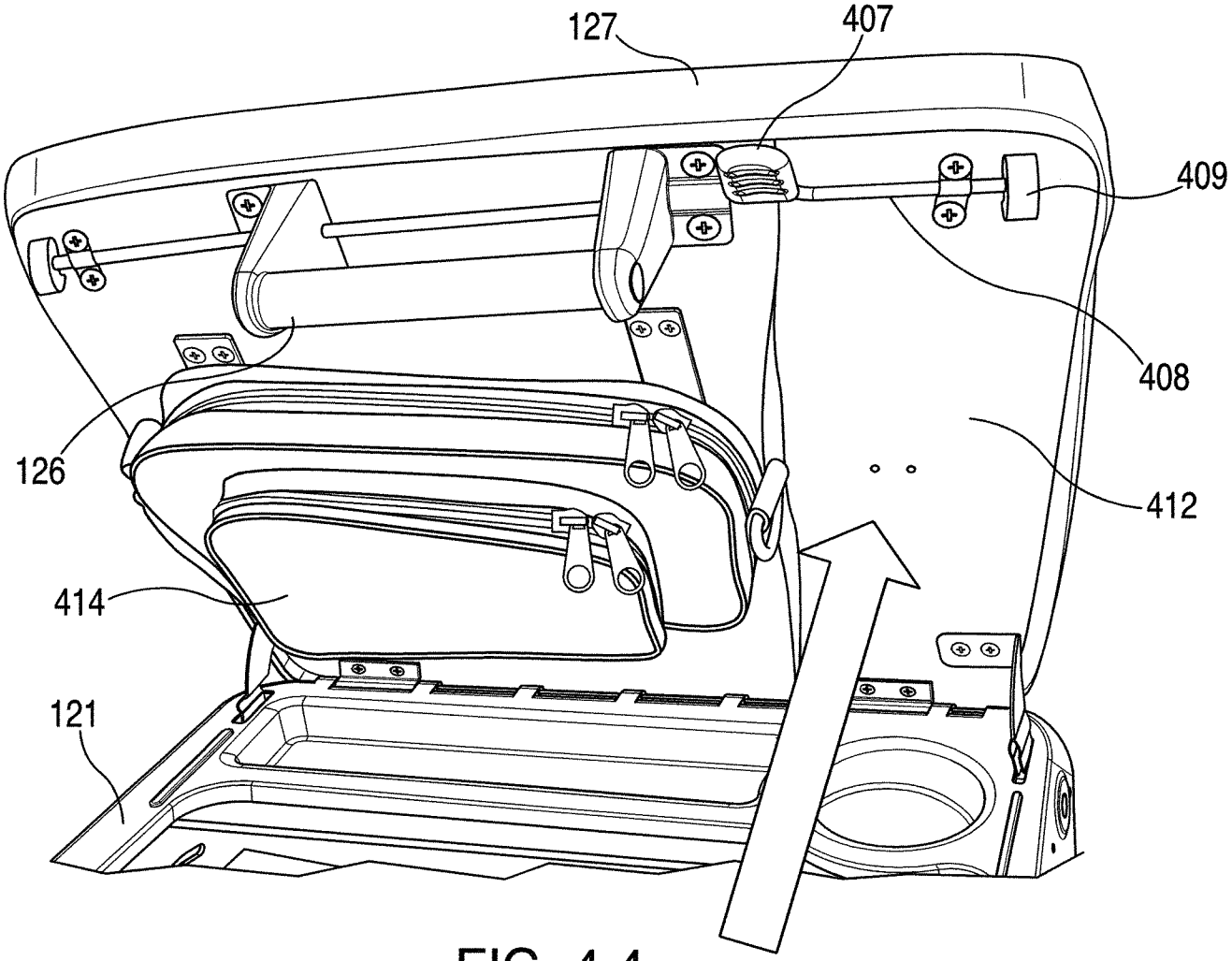
FIG. 4.4

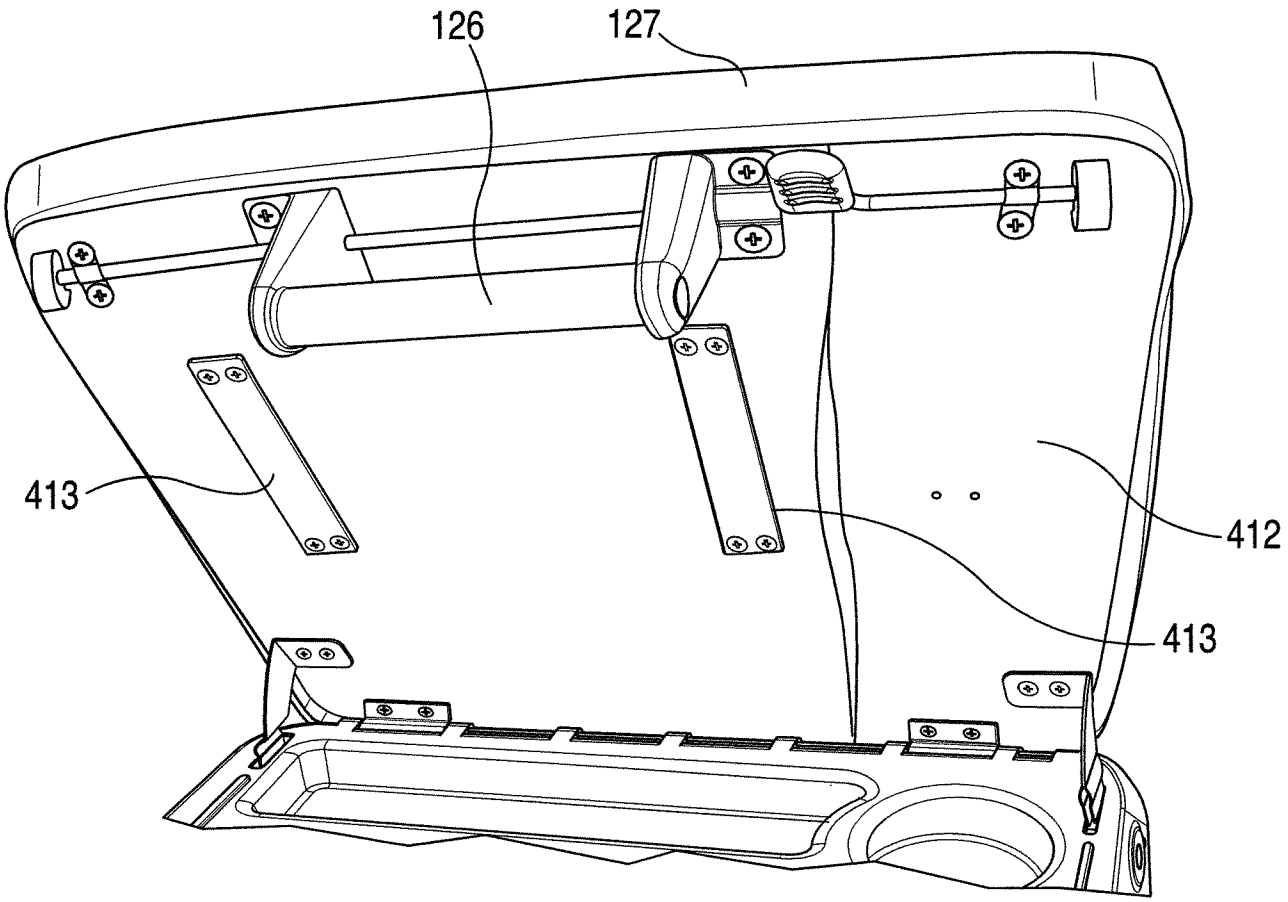
FIG. 4.5

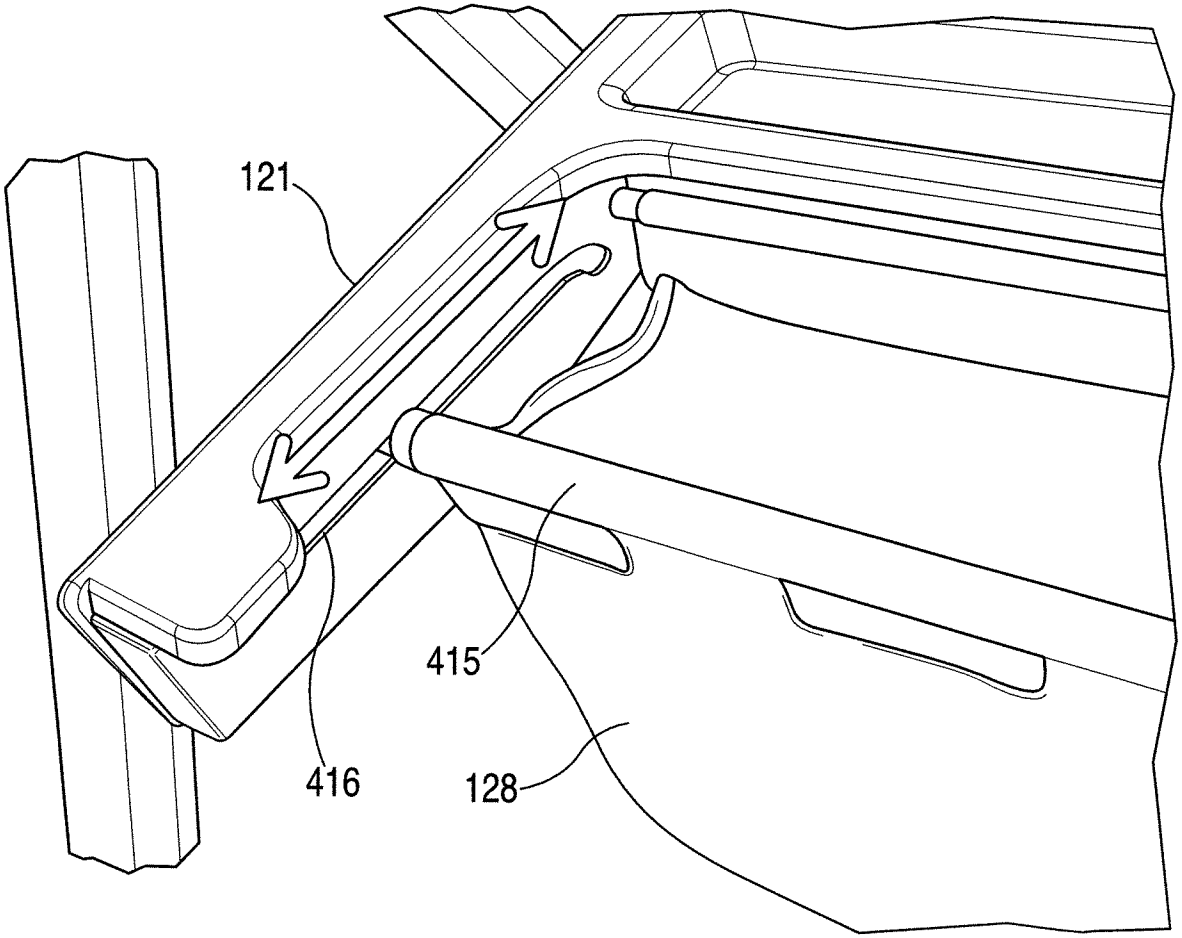
FIG. 4.6

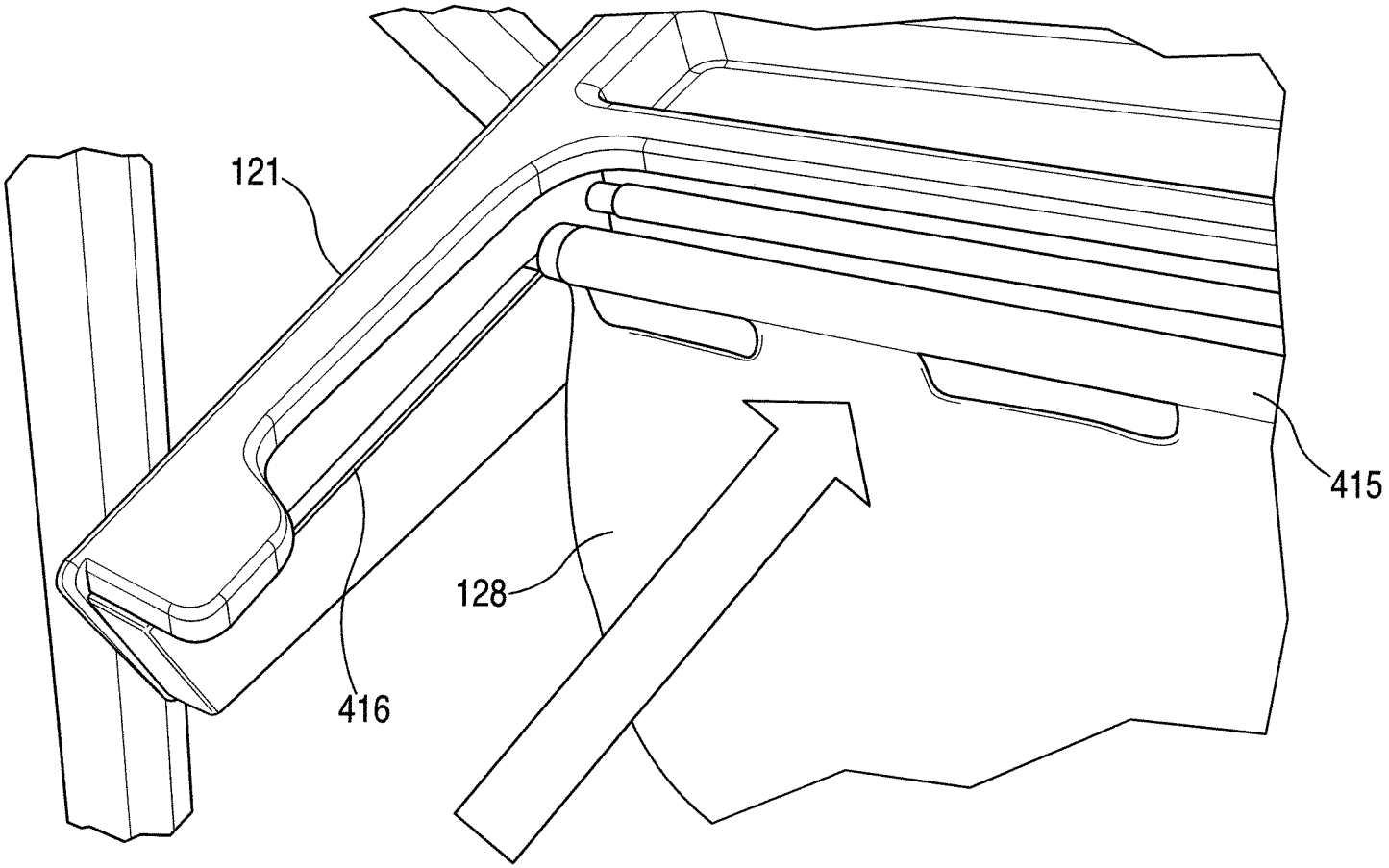
FIG. 4.7

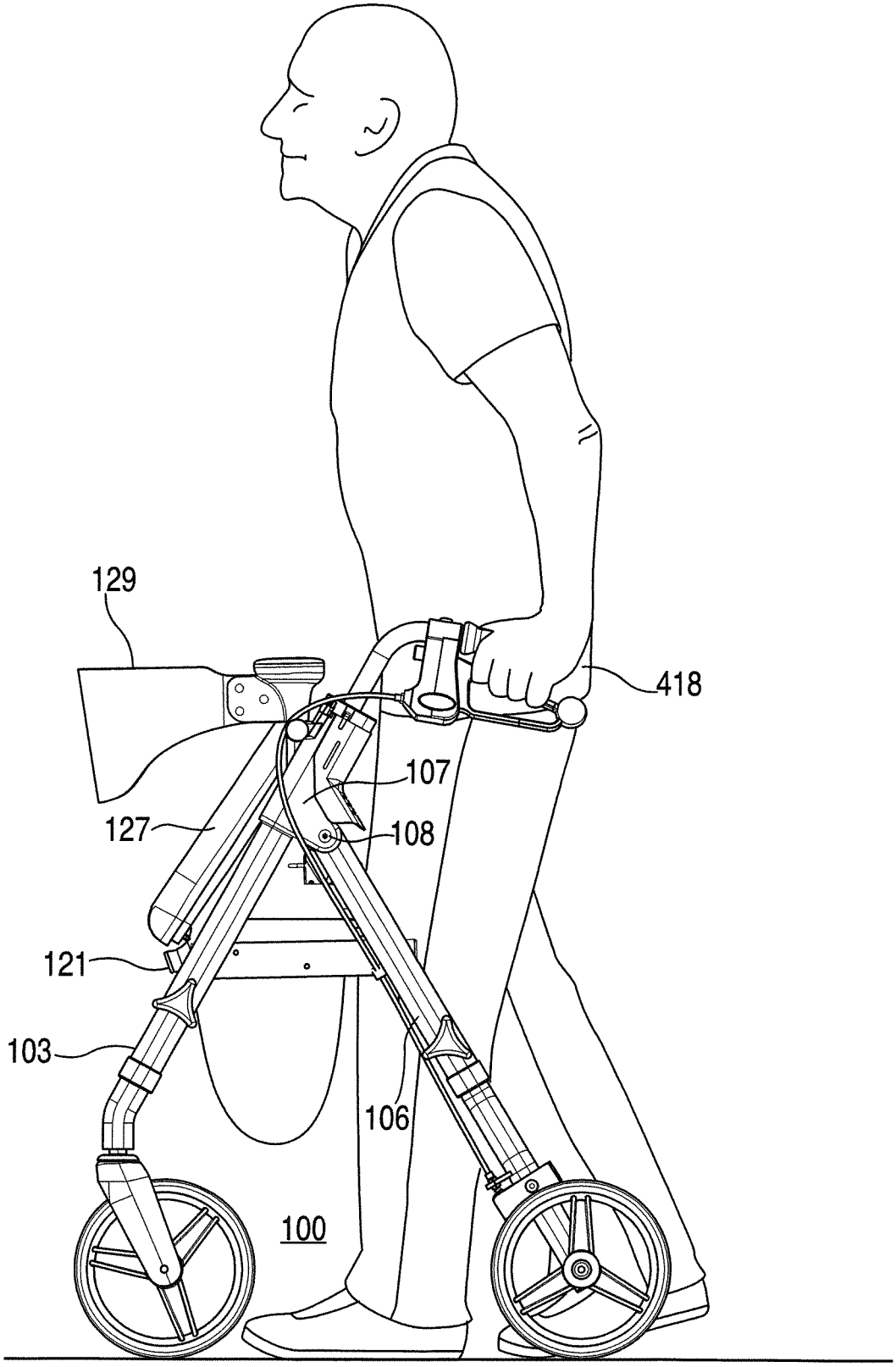
FIG. 4.8

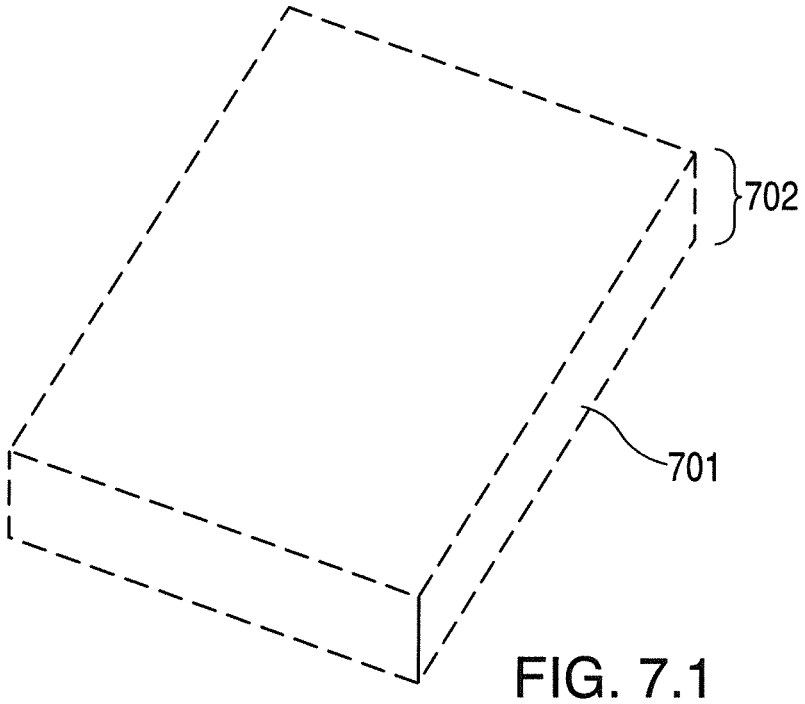
FIG. 7.1
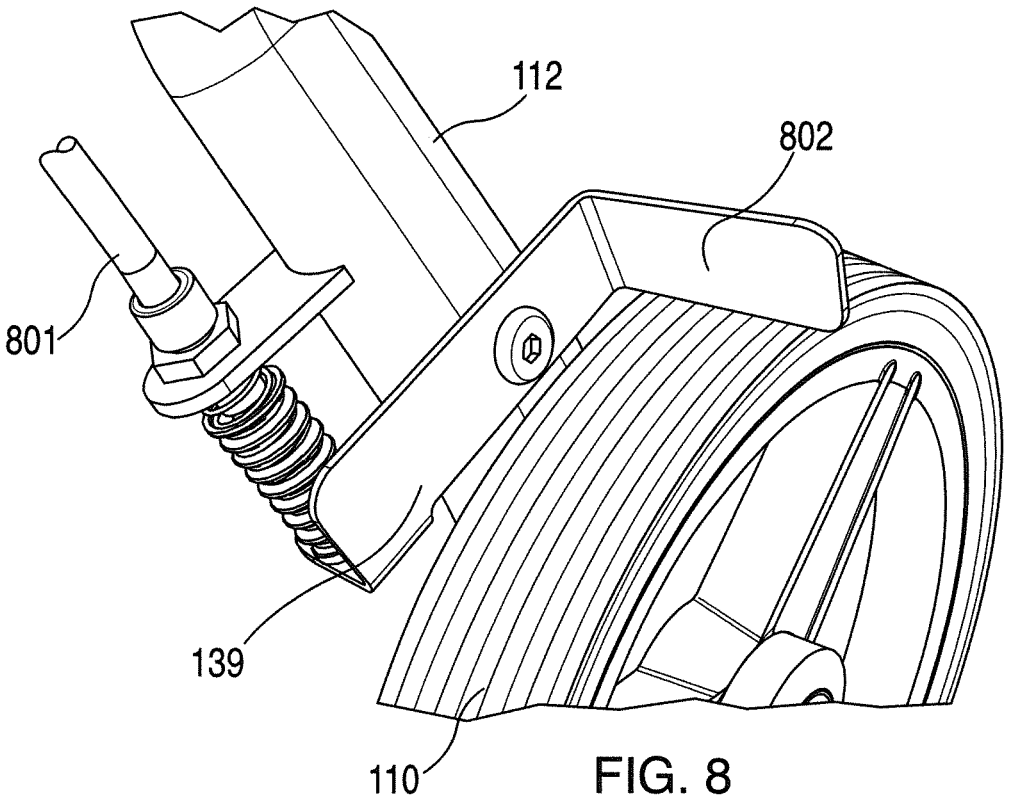
FIG. 8

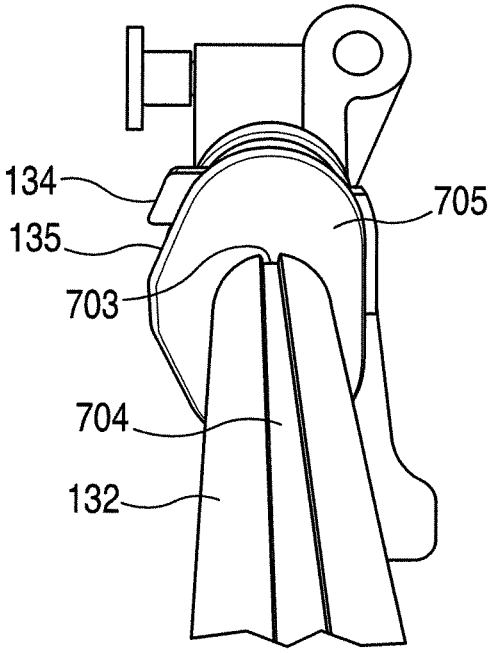
FIG. 7.3
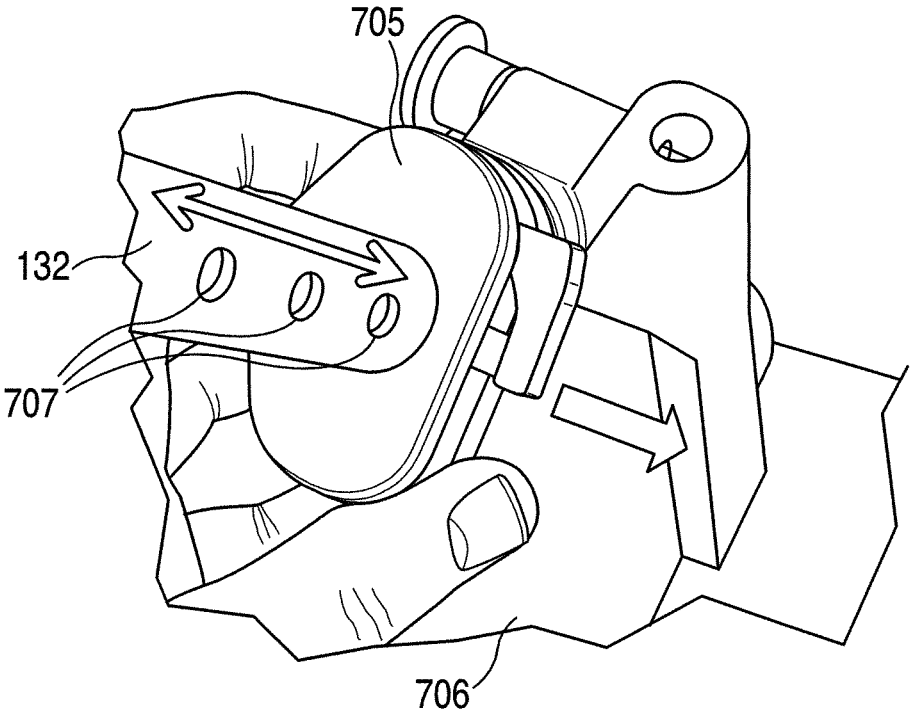
FIG. 7.4

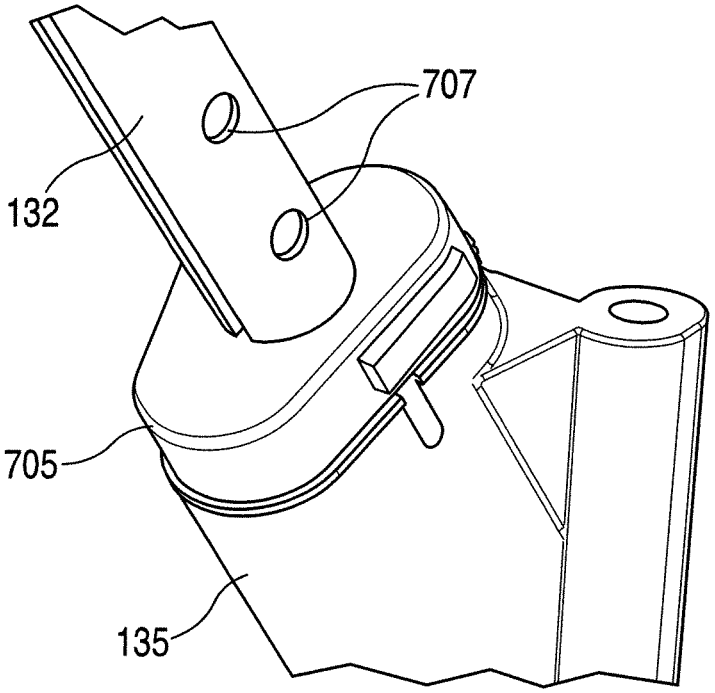
FIG. 7.2
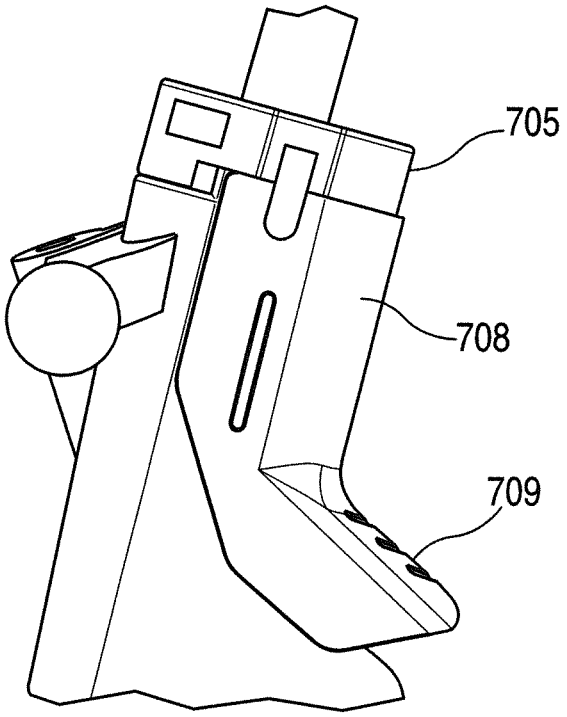
FIG. 7.5

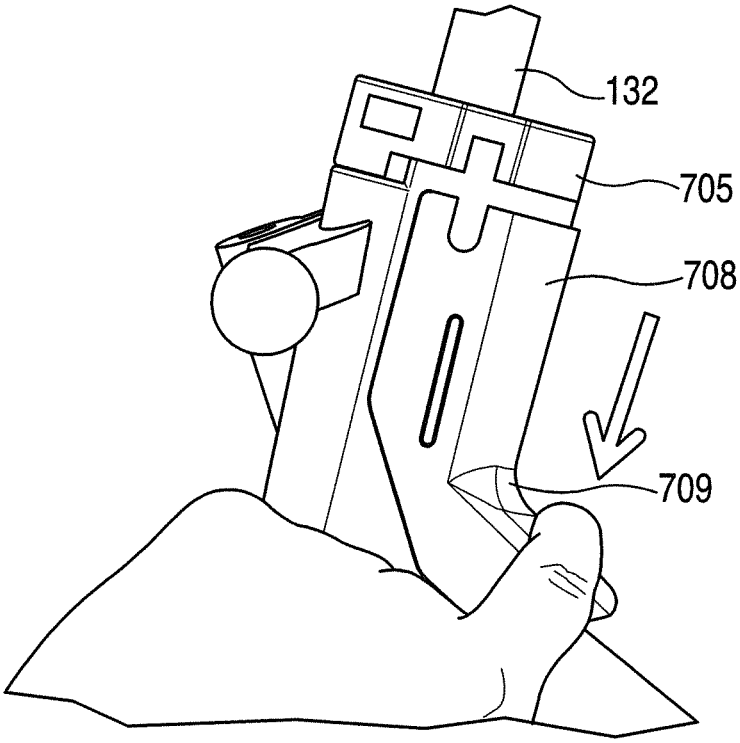
FIG. 7.6
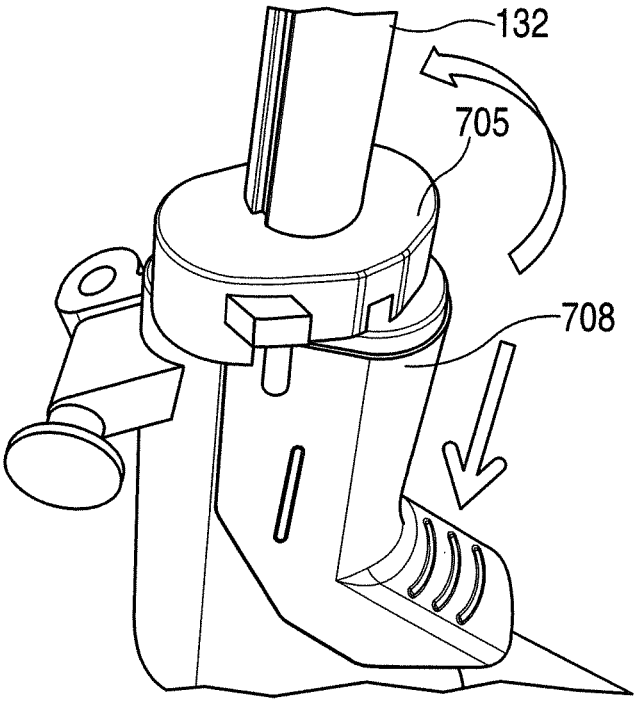
FIG. 7.7

ROLLATOR

CROSS-REFERENCE TO RELATED APPLICATIONS

This application is a continuation of prior U.S. patent application Ser. No. 15/980,164, filed May 15, 2018 which is a continuation of Ser. No. 15/722,090, filed Oct. 2, 2017 now U.S. Pat. No. 9,968,509 which is a continuation of Ser. No. 14/987,208, filed Jan. 4, 2016 now U.S. Pat. No. 9,775,766, issued Oct. 3, 2017 which is a continuation of U.S. patent application Ser. No. 14/072,206 filed Nov. 5, 2013 now U.S. Pat. No. 9,226,868, issued Jan. 5, 2016 which claims the benefit of U.S. Provisional Application No. 61/723,067, filed Nov. 6, 2012, which are all hereby incorporated herein by reference in their entirety.

TECHNICAL FIELD

This invention relates generally to rollators (also known as rolling walkers).

BACKGROUND

Wheelchairs are typically designed to transport a sitting person and so-called companion chairs are a lighter-duty mechanism having a similar operating purpose. Accordingly, both wheelchairs and companion chairs typically have leg riggings to support the transportee's lower appendages above the ground. Rollators are a walking aid and hence lack such leg riggings. That said, some rollators include a seat. This seat provides the user with a place to sit when that need arises (for example, when the user needs a break from standing or walking).

The basic design for a rollator is well established; a frame having four ground-contacting wheels and a pair of handles that the user can grip when walking with the aid of the rollator. Unfortunately, these deceptively simple design concepts are not always implemented in a fashion that well suits the needs of the expected user population. Persons who seek walking assistance can also present a variety of other maladies, infirmities, and conditions that can, in practice, interfere with their successful use of the rollator. Examples include, but are not limited to, reduced dexterity or upper-body strength, limited visual acuity, and reduced cognitive capabilities.

The rollator user population also represents a wide variety of usage patterns, lifestyles, and operating environments. Some users, for example, may only utilize their rollator within a fairly limited and constrained application setting while other users may need to frequently transport their rollators in a vehicle and more aggressively use their rollators in a variety of application settings.

BRIEF DESCRIPTION OF THE DRAWINGS

The above needs are at least partially met through provision of the IMPROVED ROLLATOR described in the following detailed description, particularly when studied in conjunction with the drawings, wherein:

FIGS. 4.1-4.8 comprises a perspective view as configured in accordance with various embodiments of the invention;

FIGS. 7.1-7.7 comprises a perspective schematic view as configured in accordance with various embodiments of the invention;

FIG. 8 comprises a front elevational detail view as configured in accordance with various embodiments of the invention;

Figure 1:
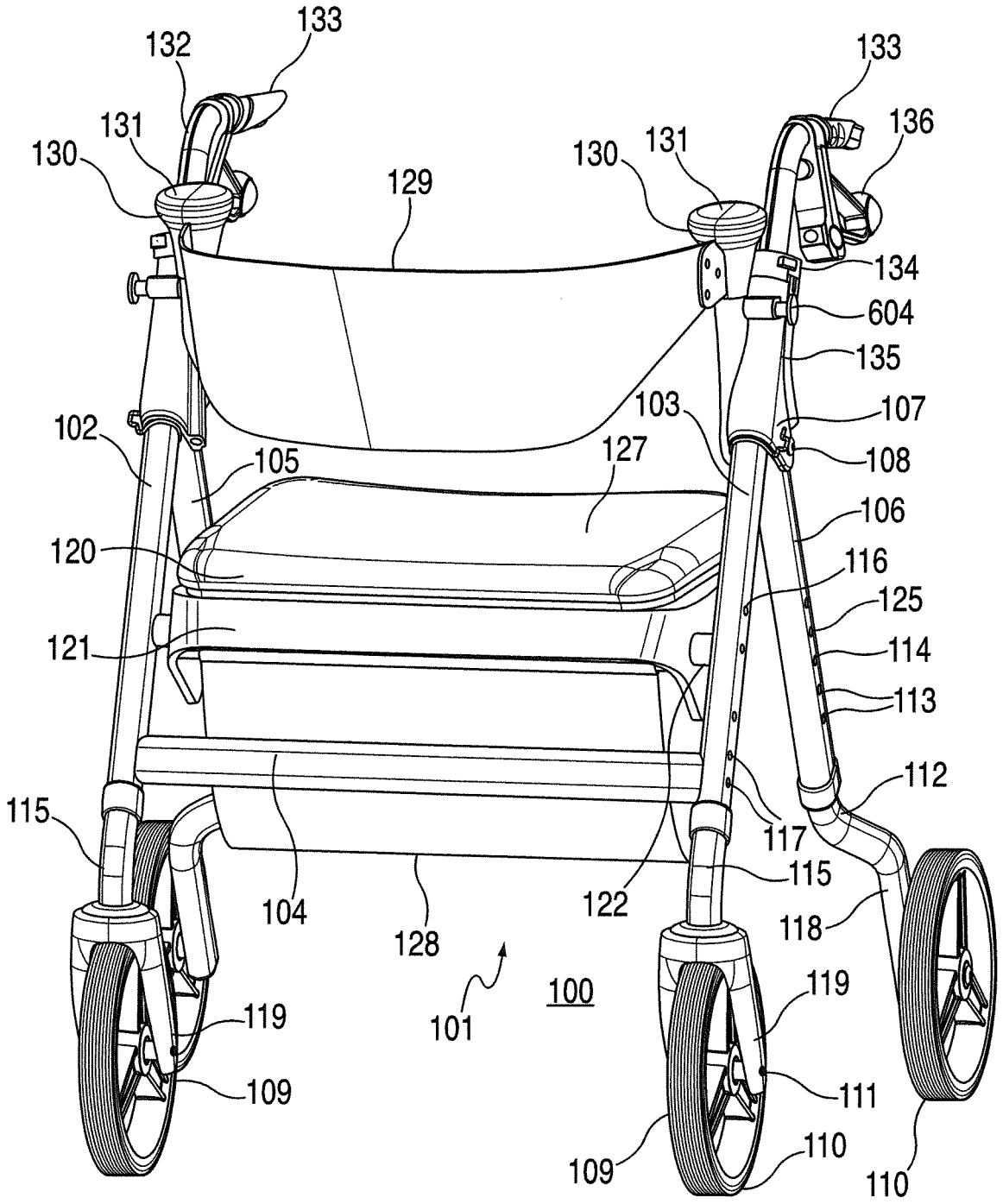
FIG. 1 comprises a front perspective view as configured in accordance with various embodiments of the invention.

Elements in the figures are illustrated for simplicity and clarity though are drawn to scale. Also, common but well-understood elements that are useful or necessary in a commercially feasible embodiment are often not depicted in order to facilitate a less obstructed view of these various embodiments. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to some of these various embodiments, a rolling walker comprises a frame, a seat supported by that frame, and a backrest supported by the frame. By one approach the backrest is configured to selectively move between a first position that provides back support for a person sitting in the seat facing in a forward direction and a second position that provides back support for a person sitting in the seat facing in a rearward direction. If desired, this backrest can be comprised of a material (such as a memory foam material) that biases the backrest towards that first position when the backrest is in the first position and that biases the backrest towards the second position when the backrest is in the second position.

By one approach this backrest can be selectively vertically adjusted to accommodate persons of differing statures and builds. A simple, intuitive, and relatively large user interface can provide the mechanism by which the user effects such an adjustment.

By one approach this backrest can include a back-support strap that couples at either end thereof to a corresponding rotating strap holder. These rotating strap holders can, in turn, be configured to provide an elbow support surface to a person sitting on the seat if desired.

To accommodate ease of transport, the frame can be configured to fold about pivot points between an unfolded state and a folded state. By one approach the right-side legs of the frame (front and back) become disposed proximal to and substantially parallel to one another when the frame is in the folded state (as are the left-side legs, front and back, of the frame). If desired, some but not all of the rollator's wheels can be laterally offset with respect to a point of attachment to the frame. So configured, all of the wheels can be substantially coaxial with one another when the frame is collapsed to the folded state. This, in turn, can permit the frame to be folded to a very compact state to thereby better facilitate, for example, placing the folded rollator into a limited storage or transport space such as a vehicle's trunk.

Also to accommodate ease of transport, and again if desired, the rollator's handles can be configured to comprise hand-graspable surfaces that can be selectively rotated between a deployed state (where the handles are disposed rearwardly of the rollator) and an undeployed state (where the handles face at least substantially inwardly towards one another). Using this approach, the handles (in the non-deployed state) can fit within at least a depth-based envelope defined by the frame when the frame is in the folded state.

By one approach, a handle height user interface permits one to selectively set these handles (individually) at any of a variety of selectable heights. This handle height user interface can comprise, for example and at least in part, a user-accessible push button.

If desired, the rollator can include brakes that a user asserts using a brake assertion interface available on the rollator's handles. The brake itself can comprise, at least in part, a wheel-contacting surface that is configured to apply braking resistance to multiple points of contact with each of at least one of the rollator's wheels. This wheel-contacting surface can comprise, for example, a substantially-straight wheel-contacting edge.

The aforementioned seat can be configured, if desired, to pivot with respect to the frame. This can permit, for example, a user to access a flexible basket disposed beneath the seat. This flexible basket can be comprised, for example, of neoprene and can serve to hold the user's items such as, by way of example, a purse, medication, binoculars, reading glasses, a water bottle, food, a cellular telephone, a portable computer, and so forth. By one approach this flexible basket can be selectively forwardly collapsed in order to permit the user to position themselves further inwardly of the rollator as may be desired.

So configured, a rollator can be readily and intuitively customized to better suit the stature and physical requirements of a given user. Such a rollator can also be easily collapsed into a considerably smaller form factor that is readily lifted and stored. These teachings can be implemented in an economical manner and can, individually or in combination with one another, offer a considerably improved rollator experience for various persons having a wide range of needs and/or preferences in these regards.

Figure 2:
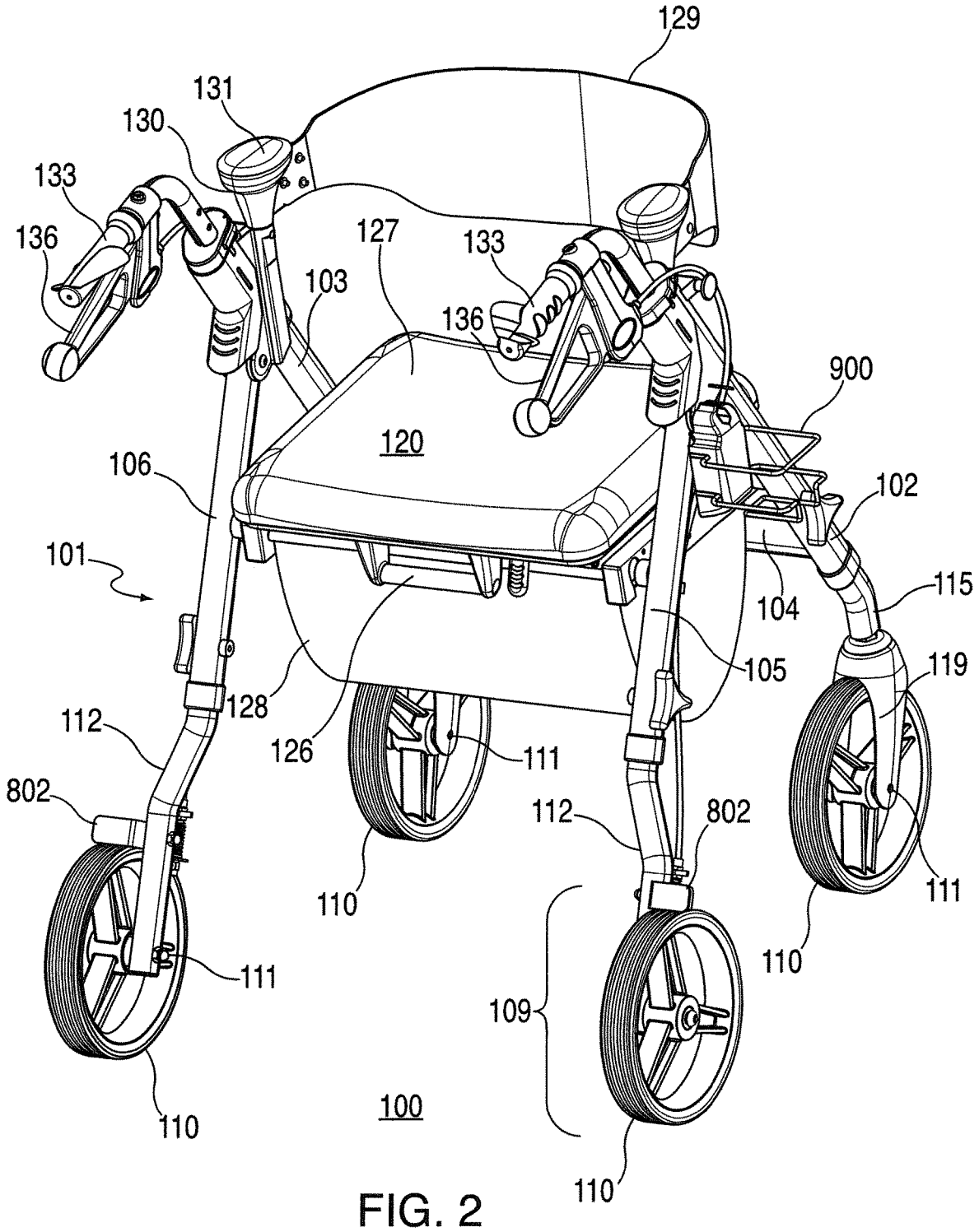
FIG. 2 comprises a rear perspective view as configured in accordance with various embodiments of the invention.

These and other benefits may become clearer upon making a thorough review and study of the following detailed description. Referring now to the drawings, and in particular to FIGS. 1 and 2, an illustrative example of a rolling walker 100 that is compatible with many of these teachings will now be presented.

In this illustrative example the rolling walker 100 comprises a frame 101 that includes a first and second front leg 102 and 103 that are coupled by a brace 104. The frame 101 also includes a first and second rear leg 105 and 106. A bracket 107 (shown as well in FIG. 4.8) couples to both of the first and second front legs 102 and 103. This bracket 107 has a hole disposed therethrough that serves as a pivot point for the first and second rear legs 105 and 106, respectively. (An axle 108 of choice can be disposed through these holes (and through a corresponding hole in the first and second rear legs 105 and 106) to further facilitate this pivoting functionality.)

Figure 3:
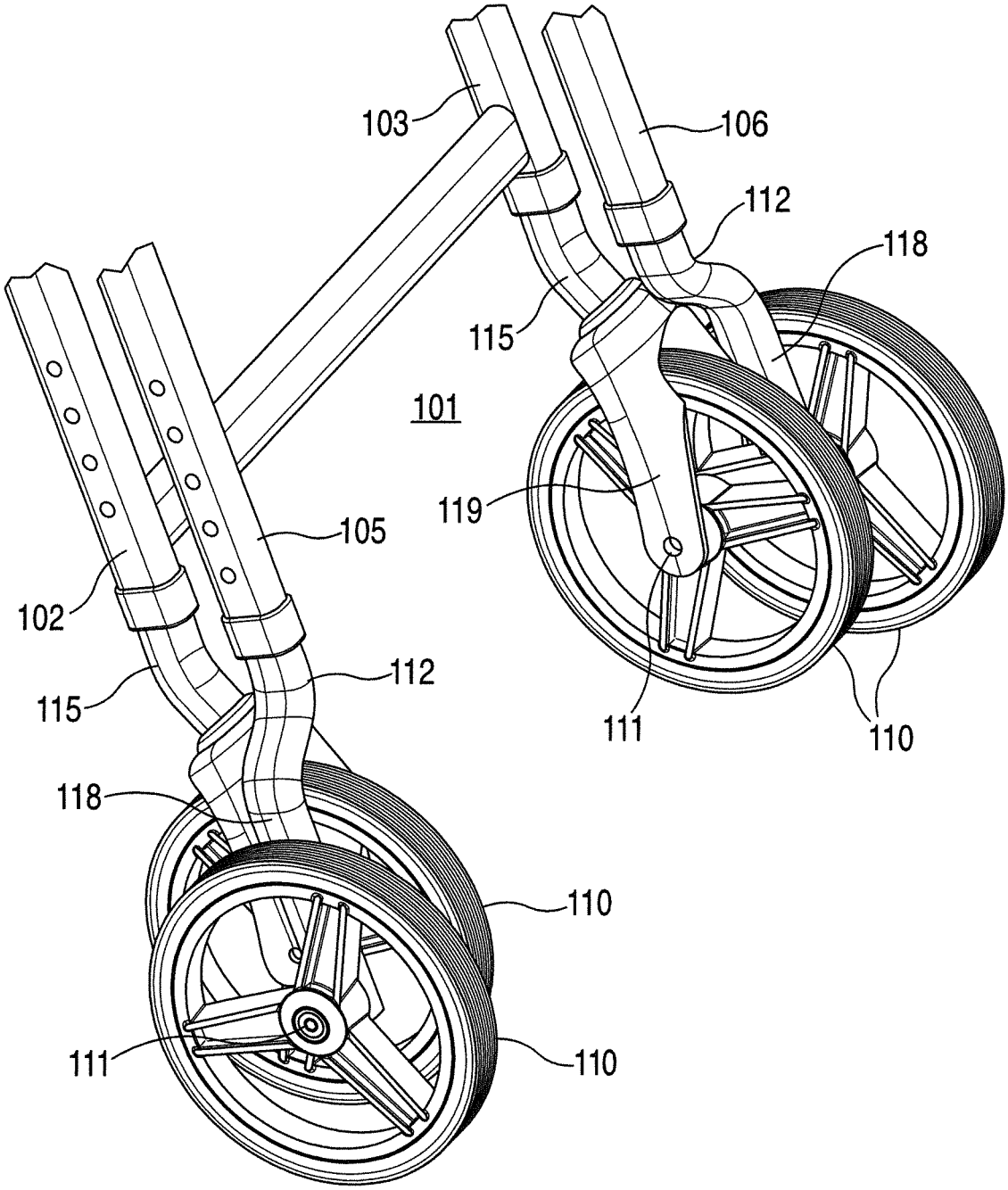
FIG. 3 comprises a perspective detail view as configured in accordance with various embodiments of the invention.

So configured, and with momentary reference to FIG. 3 as well, this frame 101 can fold about the aforementioned axles 108 between an unfolded state as shown in FIGS. 1 and 2 and a folded state as shown in part in FIG. 3. In the folded state the front legs 102 and 103 are disposed proximal to, and substantially parallel to, a corresponding rear leg 105 and 106, respectively.

The frame 101 can be comprised of any desired material including plastic and/or metal. In this example the aforementioned components 102-106 are comprised of aluminum tubes having a generally rectangular cross section. The external corners of these aluminum tubes are rounded to provide an aesthetically-pleasing form factor.

In this illustrative example a wheel assembly 109 attaches to the bottom of each leg 102, 103, 105, and 106. Each wheel assembly 109 includes a wheel 110 that rotates about an axle 111. These wheels 110 can be formed of one or more appropriate materials. By one approach the wheels 110 can include an inflated tire. By another approach the wheels 110 can comprise a solid material such as appropriate rubber or plastic material.

The rear wheels 110 each rotatably couple to a corresponding leg extension 112. These leg extensions 112, in this illustrative example, comprise aluminum tubes that are sized to conformably fit within the rear legs 105 and 106. Generally speaking, the leg extensions 112 can be sized to slide back and forth within the rear legs 105 and 106 without requiring more than a modicum of strength while nevertheless not being so small as to, for example, rattle loosely within the rear legs 105 and 106 during use.

Also in this illustrative example the rear legs 105 and 106 each include a plurality of spaced openings 113 that are sized to accommodate a user-accessible spring-biased push button 114 that comprises a part of the leg extensions 112. These openings 113 can be spaced, for example, at a desired regular distance such as one inch, two inches, or some other distance of choice. So configured, the effective length of the rear legs 105 and 106 can be varied to accommodate users having different heights. The user-accessible push buttons 114 are disposed outwardly of the frame 101 and hence are readily observed and their purpose intuitively understood by even an untrained observer. The leg extensions 112 for these rear legs 105 and 106 each also include a lower portion 118 that is substantially parallel to the aforementioned legs 105 and 106 but laterally and outwardly offset therefrom.

In this illustrative example the front wheel assemblies 109 are configured somewhat differently from the rear wheel assemblies 109. The front wheel assemblies 109 include a corresponding leg extension 115 that again includes a user-accessible spring-biased push button 116 that can be secured within one of a plurality of corresponding openings 117 in the first and second front legs 102 and 103. These leg extensions 115 for the front wheel assemblies 109, however, are not laterally offset from the legs 102 and 103 themselves. Instead, these leg extensions 115 simply angle downwardly somewhat and then rotatably couple to a fork 119 that holds the wheel's axle 111.

So configured, the effective length of the front legs 102 and 103 can again be easily and selectively varied to accommodate users of varying statures. The ability of the front wheels 110 to rotate about a vertical axis, in turn, improves the steerability of the rolling walker 100. Referring again momentarily to FIG. 3, the offset nature of the rear wheel assembles allows the front wheels to be stowed in a nested fashion with respect to the rear wheels and hence permits the rolling walker 100 to be folded into a relatively small form factor to thereby permit the folded rolling walker 100 to be more easily hefted, manipulated, and stored in a limited space. More particularly, the front and rear wheels 110 become positioned adjacent one another in corresponding pairs where the wheels 110 as comprise each pair are disposed and oriented nearly coaxial to one another.

Referring again to FIGS. 1 and 2 along with FIGS. 4.1 and 4.2, this rolling walker 100 also includes a seat 120. This seat 120 includes a seat frame 121 that couples via pivot points 122 to the front legs 102 and 103 of the frame 101. So configured, the seat frame 121 can pivot upwardly with respect to the front legs 102 and 103 of the frame 101 to facilitate folding the frame 101 into the collapsed state.

Referring to FIGS. 4.1, 4.2, and 4.3, the seat frame 121 further includes side members 124 disposed on either side of the seat frame 121. These side members 124, in turn, each have a slot 123 formed therein. This slot 123 is essentially L-shaped, with the short leg of the slot 123 extending upwardly near the rear edge of the seat frame 121. In this illustrative example rods 125 (best shown in FIG. 4.3) that couple to the rear legs 105 and 106 extend into (and can be captivated within, if desired) these slots 123. So configured, this rod 125 provides vertical support to the non-pivoting end of the seat frame 121 when the frame 101 is fully unfolded while also serving to guide the seat frame 121 into the appropriate position when folding the frame 121. The rod 125 is of sufficient size and strength to support a portion of the weight of the user when the user sits upon the seat 120.

With reference in particular to FIGS. 2 and 4.1, the seat frame 121 can further comprise a handle 126. So configured, a user can grip the handle 126 to facilitate folding the rolling walker 100 into a collapsed state. In particular, gripping this handle 126 and pulling upwardly will cause the aforementioned rods 125 to move along the aforementioned slots 123 while the seat frame 121 pivots around the aforementioned pivot points 122 as the frame 101 folds inwardly to the above-described collapsed state.

A user-support surface 127 is disposed atop the seat frame 121. By one approach the user-support surface 127 pivotally couples proximal to the front edge of the seat frame 121. With particular reference to FIGS. 4.1 and 4.2, by one approach the user-support surface 127 connects via two curved hinge members 404 that move selectively in and out of the seat frame 121 via corresponding slots 405. By one approach these curved hinge members 404 are frictionally engaged by corresponding surfaces (not shown) in the seat frame 121 such that the user-support surface 127 is maintained at any angle at which the user may leave the user-support surface 127. So configured, the user-support surface 127 can selectively pivot upwardly with respect to the seat frame 121.

By one approach a latch mechanism 406 can serve to hold the user-support surface 127 in the fully-closed position. With reference in particular to FIGS. 4.1, 4.1*a*, and 4.4, this latch mechanism 406 can comprise, for example, a latch handle 407 that attaches to a pair of rods 408 such that pivoting of the latch handle 407 will cause the rods 408 to rotate about their longitudinal axis as well. The ends of these rods 408 each terminate at a catch 409. This catch 409 includes an indented portion (410 as shown, for example, in FIG. 4.1*a*) that interacts with an edge lip 411 (as marked in FIG. 4.1) on the rear of the seat frame 121. By one approach the latch mechanism 406 can be spring biased towards a position that will serve to hold the catch 409 in an engagement state with the edge lip 411 unless and until the user overcomes that biasing by manipulating the aforementioned latch handle 407. So configured, the user-support surface 127 will remain latched and closed unless and until the user manipulates the latch handle 407 to unhook the catch 409 and thereby permit the user-support surface 127 to be pivoted open as described above.

By one approach, and referring to FIG. 4.1, the seat frame 121 can include an upper surface 401 having various features formed therein. These features can include, for example, an indented tray 402, a cupholder 403, and so forth as desired. So configured, these features become visible and accessible to a user of the rolling walker 100 when the user-support surface 127 is pivoted upwardly but otherwise remain hidden from view and are inaccessible when the user-support surface 127 is in the horizontal, latched position.

If desired, and referring now to FIGS. 4.4 and 4.5, the underside 412 of the user-support surface 127 can have, for example, hooks-and-loops 413 disposed thereon to grip and hold, for example, a zippered container 414 (as shown in FIG. 4.4). So configured the zippered container 414 can be readily secured to, and removed from, the underside 412 of the user-support surface 127. Such a zippered container 414 can serve, for example, as a wallet or small purse if desired. Such a zippered container 414 can also serve to conveniently store such things as small tools, medicines, a snack or drink, and so forth as desired.

These teachings will also accommodate, if desired, disposing a flexible basket 128 beneath the seat assembly 120. This flexible basket 128 can be comprised, for example, of a neoprene material of choice and can be supported by the frame 101. So configured, the flexible basket 128 can serve to receive and hold any of a variety of user items such as items of clothing, food or drink, communications devices, magazines, medicine or other related supplies, and so forth.

By one approach this flexible basket 128 can be configured to collapse forwardly when desired. With reference to FIGS. 4.1, 4.2, 4.6, and 4.7, the rearward edge 415 of the flexible basket 128 can include a rod having its ends disposed within a corresponding track 416 formed on an inner surface of the seat frame 121. As denoted by the white arrow in FIG. 4.6, such a configuration will permit the rearward edge 415 of the flexible basket 128 to be moved back and forth along that track 416. This capability, in turn, permits a user to move that rearward edge 415 forward (as shown in FIG. 4.7) until the flexible basket 128 is essentially vertically collapsed.

Moving the flexible basket 128 to a vertically-collapsed state as described above, in turn, opens up a space (417 as illustrated in FIG. 4.2) that will permit the user to move forwardly within the ambit of the rollator 100 as shown in FIG. 4.8. In particular, the user 418 is able to move further forwardly within the frame 101 of the rollator 100 when the user-support surface 127 is pivoted upwardly and forwardly as described above and when the flexible basket 128 is vertically collapsed as described above. This flexibility regarding the position of the user with respect to the rollator 100 can serve to better accommodate a range of application settings, user preferences, and so forth.

Generally speaking, the aforementioned user-support surface 127 serves, at least in part, to support a sitting person. Accordingly, this user-support surface 127 will permit a walking or standing user to rest in a sitting position as desired.

With reference to FIGS. 1 and 2, by one approach the rolling walker 100 can further comprise a backrest 129. In this illustrative example the frame 101 supports this backrest 129. This backrest 129 can be comprised, for example, of a flexible material such as, but not limited to, memory foam material and neoprene.

Figure 5:
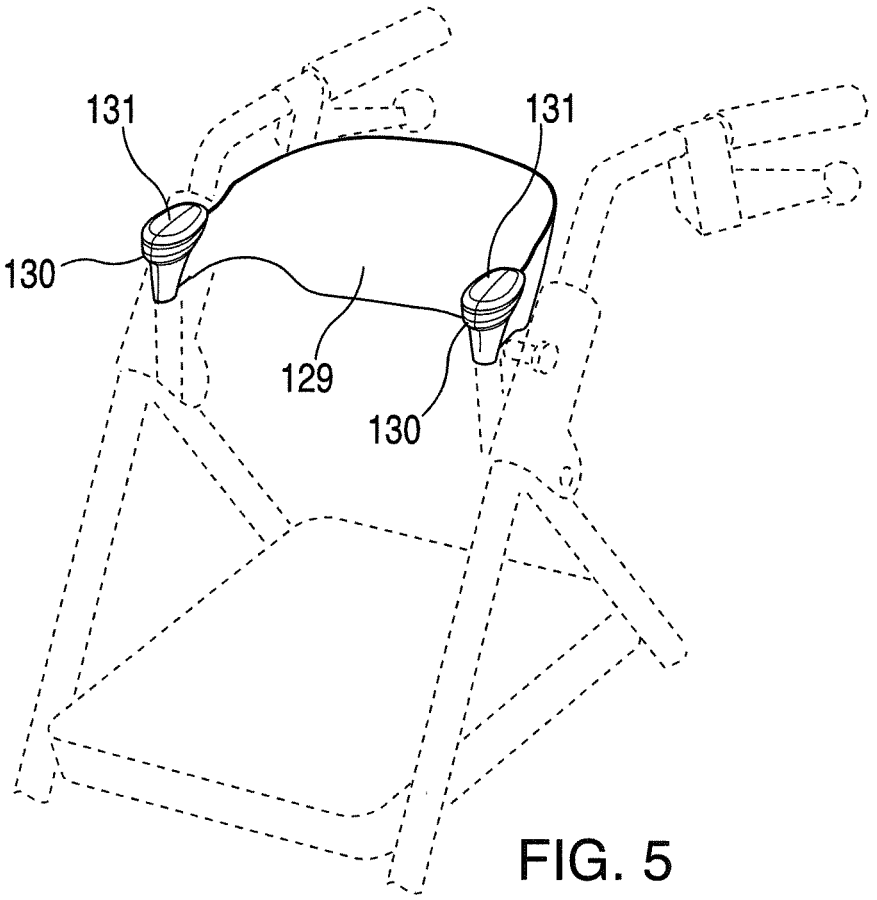
FIG. 5 comprises a front perspective detail view as configured in accordance with various embodiments of the invention.

In this illustrative example, the opposing ends of the backrest 129 connect to corresponding rotating strap holders 130. If desired, and as shown, these rotating strap holders 130 can be configured to provide an elbow support surface 131 to a person sitting on the seat 120. Because these strap holders 130 can rotate about their vertical axis, the backrest 129 can, in turn, selectively move between one position that provides back support for a person sitting in the seat 120 facing in a rearward direction (as shown in FIG. 1) and another position that provides back support for a person sitting in the seat 120 facing in a forward direction (as shown in FIG. 5).

By one approach, the user can move the backrest 129 between these two backrest orientations by simply grasping the backrest 129 (near, for example, the center thereof) and pulling the backrest 129 towards the desired orientation. When the backrest 129 comprises flexible material, the backrest 129 will readily follow such an action and the rotating strap holders 130 will freely rotate to permit the backrest 129 to reach the opposing orientation.

When the backrest 129 comprises a material having some resiliency (in addition to the aforementioned flexibility), the backrest 129 will further serve to bias the backrest 129 towards the first position noted above when the backrest 129 is, in fact, in that position, and will also serve to bias the backrest 129 towards the second position noted above when the backrest 129 is, in fact, in that second position. Such a configuration will help retain the backrest 129 in a desired state of deployment and available and ready for service.

Figure 6:
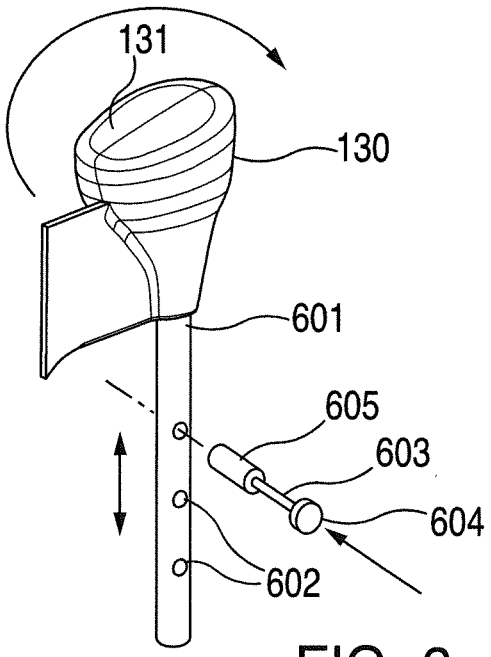
FIG. 6 comprises a perspective detail view as configured in accordance with various embodiments of the invention.

If desired, this backrest 129 can be vertically adjusted in height. By one approach, and referring to FIG. 6, the upper portion of the strap holders 130 can rotatably couple to a vertical rod 601. These vertical rods 601, in turn, can have a plurality of holes 602 disposed therethrough and sized to receive a pin 603 as comprises a part of a vertical adjustment user interface. This vertical adjustment user interface can further comprise a button 604 that attaches perpendicularly to one end of the pin 603 and provides a simple mechanism by which the user can selectively manipulate the vertical adjustment user interface to permit the vertical rod 601 to move selectively up and down to a desired position and to then lock the vertical rod 601 at the desired height by moving the pin 603 into a corresponding one of the aforementioned holes 602. A housing 605 can serve to retain and guide at least a portion of the pin 603 and can also include a spring (not shown) to bias the pin 603 inwardly towards the interior of the frame 101.

So configured, a user can readily determine the means by which the backrest 129 can be moved to a different height. The described approach is also simple and intuitive to employ in these same regards.

This rolling walker 100 can also include, if desired, handles 132 that are supported by the frame 101 and that provide hand-graspable surfaces 133 to facilitate a user using the rolling walker 100 in the unfolded state to aid in maintaining their balance when walking or standing. By one approach, and referring momentarily to FIGS. 7.2, 7.3, and 7.4, a portion of each handle 132 can be sized and configured to slide in and out of a housing 135. If desired, a collar 705 can have one or more keys 703 formed therein to mate with corresponding slots 704 that are formed in the aforementioned handle 132. So configured, the handle 132 will slide in and out of the collar 705 without also rotating with respect to the collar 705.

A hand-operated push button 134 (FIG. 7.3) can serve to lock each handle 132 at a particular desired point of extension. This push button 134 can be spring biased towards and can connect to a locking pin 706 (FIG. 7.4) that in turn enters a given hole 707 as provided along the length of the handle 132 to thereby lock the handle 132 with respect to the collar 705. So configured the user can easily change the height of the hand-graspable surfaces 133 to accommodate their own physical needs and preferences.

If desired, another latch mechanism 708 can serve as a handle-rotation user interface that permits the user to selectively rotate the handles 132 between a deployed state (as shown in FIGS. 1 and 2) where the hand-graspable surfaces 133 are disposed rearwardly of the rolling walker 100 and an undeployed state where the hand-graspable surfaces 133 face at least substantially inwardly towards one another. With the hand-graspable surfaces 133 so disposed, and as generally suggested by the schematic illustration provided at FIG. 7.1, the handles 132, including the hand-graspable surfaces 133, are disposed within the vertical confines 702 of an envelope 701 defined by remaining components of the rolling walker 100 when the rolling walker 100 is folded into its undeployed, collapsed state. This, in turn, prevents the handles 132 from requiring more vertical storage space than the rolling walker 100 would otherwise require when stored flat.

Referring to FIGS. 7.5 and 7.6, this latch mechanism 708 can include a paddle surface 709 that a user can assert downwardly as shown in FIG. 7.6. This movement, in turn, can serve to disengage interlocking members with respect to the latch mechanism 708 and the aforementioned collar 705. With reference to FIG. 7.7, this disengagement can in turn permit the collar 705 to rotate as denoted by the curved arrow, either clockwise or counterclockwise as desired. Since the handle 132 connects to the collar 705 as described above, rotation of the collar 705 will cause a like rotation of the handle 132 as well to thereby permit the hand-graspable surfaces 133 to be aligned as desired. By one approach the collar 705 can be configured to so rotate between two lockable positions (corresponding to the deployed and collapsed states of the rollator 100 as a whole), where both lockable positions can be unlocked by the aforementioned downward movement of the latch mechanism 708.

Referring now to FIGS. 2 and 8, the rolling walker 100 can further comprise a hand-operated braking system. This can include a hand-graspable actuator 136 located proximal the aforementioned hand-graspable surfaces 133 of the handles 132. Pulling this actuator 136 upwardly, for example, can cause a wire 801 to pull up on a pivoting member 139 that causes a brake element 802 to come into frictional contact with a corresponding wheel 110. Such brake mechanisms are generally well known in the art and require no further elaboration here except to note that, if desired, the hand-graspable actuator 136 can be configured to lock in the brake-applied configuration by moving the hand-graspable actuator 136 away from the hand-graspable surface 133. In such a case, the locked-state can be released by, for example, pulling upwardly again on the hand-graspable actuator 136.

Figure 10:
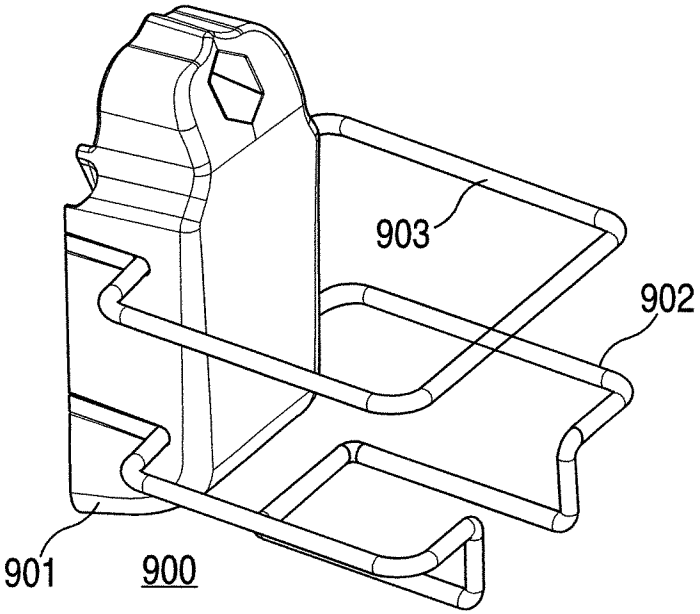
FIG. 10 comprises a perspective view as configured in accordance with various embodiments of the invention.
Figure 9:
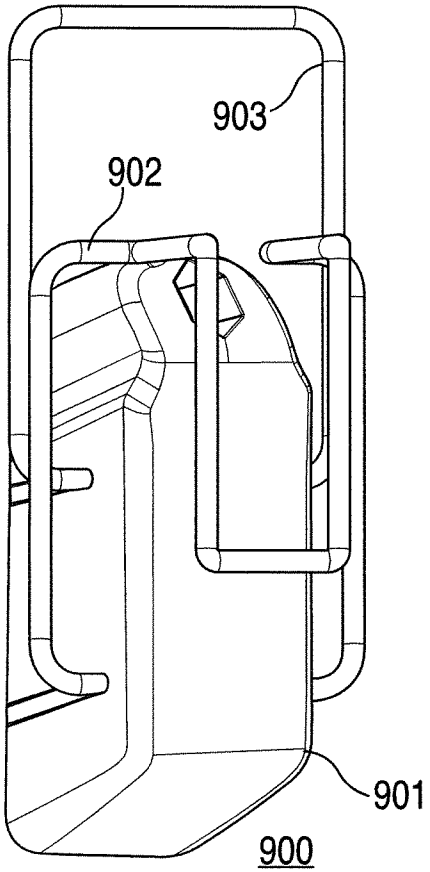
FIG. 9 comprises a perspective view as configured in accordance with various embodiments of the invention.
Figure 11:
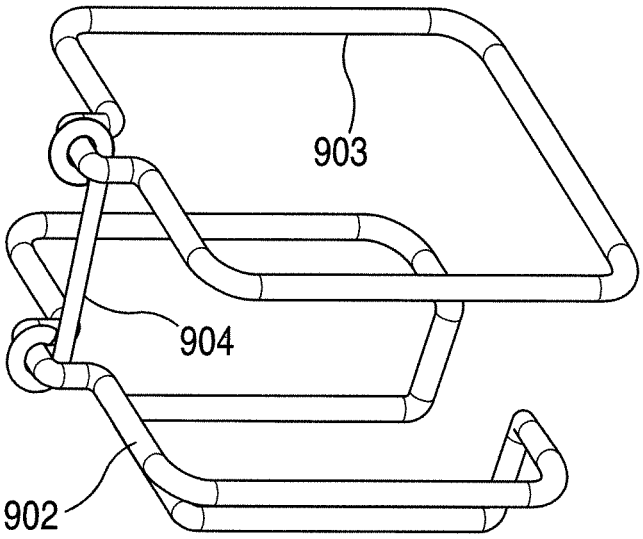
FIG. 11 comprises a perspective view as configured in accordance with various embodiments of the invention.

This basic approach to a rolling walker design will accommodate any of a wide variety of alterations and/or embellishments. As but one simple example in these regards, one or more cupholders of choice can be attached thereto as desired. As one specific example in these regards, but without intending any particular limitations in these regards, a collapsible cupholder 900 as shown in FIGS. 1 and 9-11 can be attached, for example, to one of the legs of such a rolling walker 100. Such a cupholder 900 can have a main body 901 (comprised, for example, of a suitable plastic material) configured to attach to a desired surface on the rolling walker 100. A tray component 902 and a corresponding retainer component 903 (formed, for example, of metal or plastic) can be pivotally coupled to the main body 901 and can be flexibly joined to one another by a bridge piece 904 (as shown in FIG. 11). So configured the tray component 902 and retainer component 903 can be pivoted (jointly) to a collapsed configuration as shown in FIG. 9 or positioned instead in a deployed configuration as shown in FIG. 10. Such a collapsible cupholder 900 affords the user the opportunity to have and utilize a convenient cupholder when needed and to collapse the cupholder 900 into a smaller-sized form factor when not needed to reduce the overall profile and size of the rolling walker 100.

These various teachings described herein can be used alone or in various combinations as desired. The resultant rolling walker will benefit accordingly. More particularly, a rolling walker that comports with these teachings can be made relatively inexpensively while providing superior usability and functionality. Various dimensions are readily modified to suit the particular physical circumstances of a given user. Furthermore, the mechanisms by which such modifications are effected are simple to discern, understand, and operate. These teachings also permit a rolling walker to be collapsed into a very small package that can be more easily handled and stored.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept. In these regards, an appendix as is attached hereto and made a part hereof includes a number of views as correspond to many such possibilities.

What is claimed is:

1. A rolling walker comprising:

a frame;

a backrest supported by the frame;

a seat frame supported by the frame;

a user-support surface pivotally attached proximal to a front edge of the seat frame via two curved hinge members such that the user-support surface selectively pivots upwardly with respect to the seat frame;

a tray disposed on the seat frame and beneath the user-support surface when the user-support surface is in a horizontal position, wherein the tray includes two slots formed therethrough, and wherein each one of the two curved hinge members is disposed within a corresponding one of the two slots.

2. The rolling walker of claim 1 wherein the seat frame further includes surfaces that frictionally engage the two curved hinge members to thereby frictionally hold the user-support surface at any of a variety of user-selected angles.

3. The rolling walker of claim 1 wherein the tray includes indented features to hold user items.

4. The rolling walker of claim 3 wherein at least one of the indented features comprises a cupholder.

5. The rolling walker of claim 3 wherein at least one of the indented features comprises an indented tray.

6. A rolling walker comprising:

a frame;

a backrest supported by the frame;

a seat frame supported by the frame;

a user-support surface pivotally attached to the seat frame such that the user-support surface selectively pivots upwardly with respect to the seat frame;

a tray disposed on the seat frame and beneath the user-support surface when the user-support surface is in a horizontal position, the tray having indented features to hold user items, wherein a first one of the indented features comprises a cupholder and another of the indented features comprises an indented tray.

7. The rolling walker of claim 6 wherein the indented tray is disposed longitudinally parallel to a front edge of the seat frame.

8. The rolling walker of claim 7 wherein the cupholder is disposed laterally with respect to the indented tray.

9. The rolling walker of claim 8 wherein the cupholder is disposed on a starboard side of the indented tray.

* * * * *